US006062919A

United States Patent [19]

Trafton

[11] Patent Number: 6,062,919

[45] Date of Patent: May 16, 2000

[54] ELECTRICAL CONNECTOR ASSEMBLY HAVING HIGH CURRENT-CARRYING CAPABILITY AND LOW INSERTION FORCE

[75] Inventor: Michael L. Trafton, Dearborn, Mich.

[73] Assignee: Thomas & Betts International, Inc., Sparks, Nev.

[21] Appl. No.: 09/137,360

[22] Filed: Aug. 20, 1998

Related U.S. Application Data

[60] Provisional application No. 60/057,214, Aug. 29, 1997.

[51] Int. Cl.[7] ..... H01R 13/187

[52] U.S. Cl. ..... 439/843

[58] Field of Search ..... 439/843, 846, 439/847, 852, 927, 891, 860, 553

[56] References Cited

U.S. PATENT DOCUMENTS

| | | | |
|---|---|---|---|
| 2,426,429 | 8/1947 | Bels | 173/324 |
| 3,206,706 | 9/1965 | Cataldo et al. | 339/22 |
| 3,453,587 | 7/1969 | Neidecker | 339/256 |
| 3,861,776 | 1/1975 | Deal | 339/74 R |
| 4,083,622 | 4/1978 | Neidecker | 339/256 R |
| 4,128,293 | 12/1978 | Paoli | 439/843 |
| 5,147,229 | 9/1992 | Nestor | 439/843 |
| 5,213,518 | 5/1993 | Weidler | 439/211 |
| 5,431,576 | 7/1995 | Matthews | 439/247 |
| 5,509,819 | 4/1996 | Stein et al. | 439/189 |
| 5,619,014 | 4/1997 | Faulkner | 174/68.2 |
| 5,667,413 | 9/1997 | Trafton | 439/843 |

*Primary Examiner*—Khiem Nguyen
*Assistant Examiner*—Javaid Nasri
*Attorney, Agent, or Firm*—Weingarten, Schurgin, Gagnebin & Hayes LLP

[57] ABSTRACT

A low insertion force, high current electrical connector assembly that is capable of transmitting a wide range of current levels, particularly high levels of current such as that found in a power distribution center, is provided. The connector assembly includes a cylindrical housing having an open end to receive a pin. A contact cage having a number of flexible beams is positioned concentrically within the housing to surround and contact the pin. The beams are provided in sets or banks which are offset from each other by zig-zag bridge members. The zig-zag bridge members ease the process of rolling the cage into a generally cylindrical shape for insertion into the housing and provide a compact design to reduce material consumption. The housing includes a reduced diameter section which acts as an overstress protector for the contact cage by minimizing movement of the pin within the housing and as a positive stop for the contact cage once it is assembled within the housing. The housing may also include an annular recess in the exterior wall which serves as a keying feature for connection of the housing to another component, such as a bus bar.

16 Claims, 4 Drawing Sheets

ELECTRICAL CONNECTOR ASSEMBLY HAVING HIGH CURRENT-CARRYING CAPABILITY AND LOW INSERTION FORCE

CROSS REFERENCE TO RELATED APPLICATIONS

This application claims the benefit under 35 U.S.C. § 119(e) of U.S. application Ser. No. 60/057,214, filed on Aug. 29, 1997, the disclosure of which is incorporated by reference herein.

STATEMENT REGARDING FEDERALLY SPONSORED RESEARCH OR DEVELOPMENT

N/A

BACKGROUND OF THE INVENTION

Electrical connectors having the capability to carry high electrical currents are useful in a variety of applications. For example, in automobiles, such a connector can be used in a power distribution center to carry current between components or to bring current to particular components, such as an alternator.

Typically, a connection is made by terminating a flat terminal to a wire. The terminal has one or more round holes. The hole is placed over a threaded stud pressed into a bus bar, and the two are bound together by assembling a nut to the stud, thereby contacting the terminal to the bus bar. The torque with which the nut is applied must be carefully monitored to be effective. Should the nut come loose, a poor connection occurs which could lead to either no current passing or the creation of a high resistance condition causing excessive heating of the junction and consequent thermal damage to the attached device. Additionally, attachment of a nut requires more time and effort, as well as damage to the device should the nut be misapplied.

Another type of high current carrying connector system establishes an electrical connection between a housing providing a socket therein and a pin which can be inserted within and removed from the socket in the housing. A connector cage is provided within the socket to increase the number of contact points between the pin and the housing. The cage is fixed within the socket and includes a number of flexible beams which are biassed into contact with the pin when the pin is inserted into the socket. In this manner, a high electrical current can travel between the pin and the housing. The force required to insert the pin within the socket should be as small as possible, so that the pin can be readily inserted, preferably with one hand.

BRIEF SUMMARY OF THE INVENTION

The present invention provides a low insertion force, high current electrical connector assembly that is capable of transmitting a wide range of current levels, particularly high levels of current such as that found in a power distribution center.

The connector assembly includes a cylindrical housing which is retained in electrical communication with a bus bar or other component feed which in turn is mounted to a component which requires electrical current. The housing, which is formed of an electrically conductive material, has at least one open end and an interior wall defining a socket for receiving an electrically conductive pin. A contact cage, also formed of an electrically conductive material, has a cylindrically rolled configuration and is positioned concentrically within the housing to surround the pin and to be in electrical communication with the interior wall of the housing. The cage also includes a number of flexible beams which include protrusions for contact with the pin or are otherwise biassed into contact with the pin to provide a number of electrical contact points between the cage and the pin.

The beams are provided in sets or banks which are offset from each other. Bridge members are provided to offset the second set. The bridge members are preferably angled to have a zig-zag configuration. The zig-zag bridge configuration eases the process of rolling the cage into a generally cylindrical shape for insertion into the housing and provides a compact design to reduce material consumption.

The housing includes a section having a reduced diameter which acts as an overstress protector for the contact cage by minimizing movement of the pin within the housing. This section also provides a positive stop for the contact cage once it is assembled within the housing. The inner edge near the reduced diameter section may be chamfered to ease insertion of the pin into the housing. The housing may also include an annular recess in the exterior wall which serves as a keying feature for connection of the housing to another component, such as a bus bar.

DESCRIPTION OF THE DRAWINGS

The invention will be more fully understood from the following detailed description taken in conjunction with the accompanying drawings in which.

DETAILED DESCRIPTION OF THE INVENTION

Figure 1:
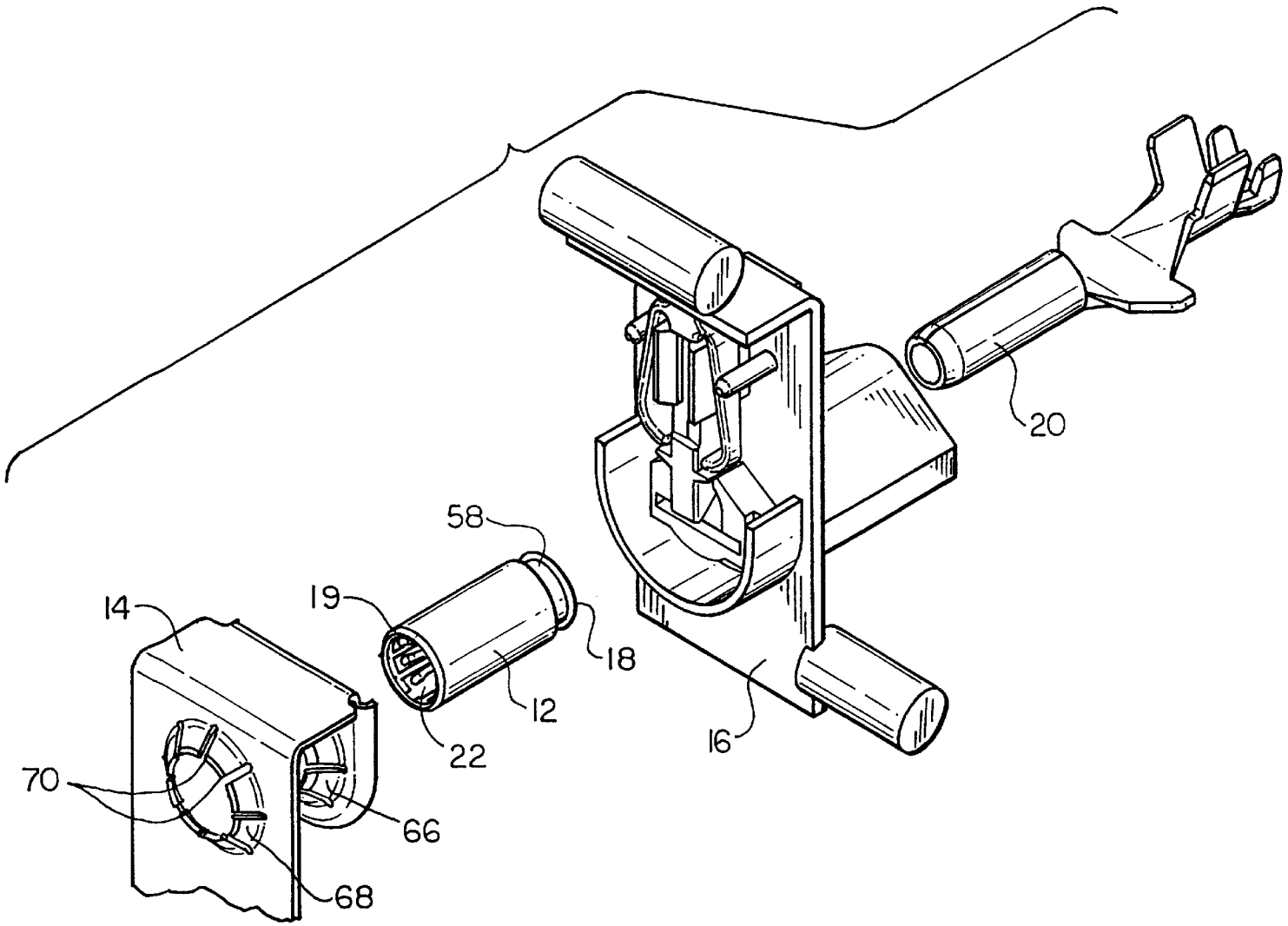
FIG. 1 is an exploded isometric view of an electrical connector assembly according to the present invention.

Referring to FIGS. 1 through 7, a low insertion force, high current electrical connector assembly 10 of the invention includes a housing 12 which is retained in electrical communication with a bus bar 14 or other component feed which in turn is mounted to a component 16 which requires electrical current. The housing 12 has at least one open end 18 to receive a pin 20, illustrated as a rolled pin capable of receiving a wire in the embodiment shown. A contact cage 22 having at least two sets 24, 26 of resilient beams 28 is positioned concentrically within the housing 12 to surround the pin 20. The contact cage has a rolled cylindrical configuration with a split 27 extending from one edge to the other. The beams 28 include protruding sections 30 for contact with the pin 20 or are otherwise biassed into contact with the pin to provide a number of electrical contact points between the cage and the pin.

Figure 7:
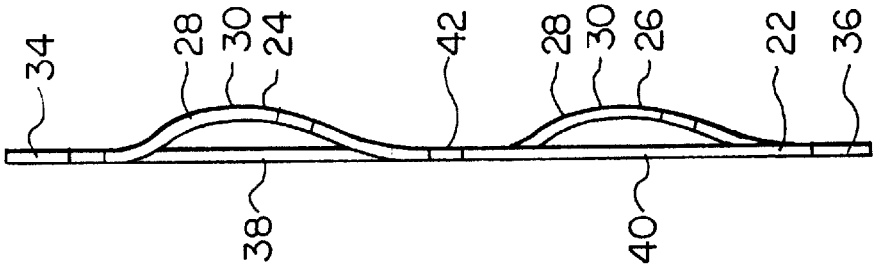
FIG. 7 is a side view of the unrolled contact cage of FIG. 6.
Figure 6:
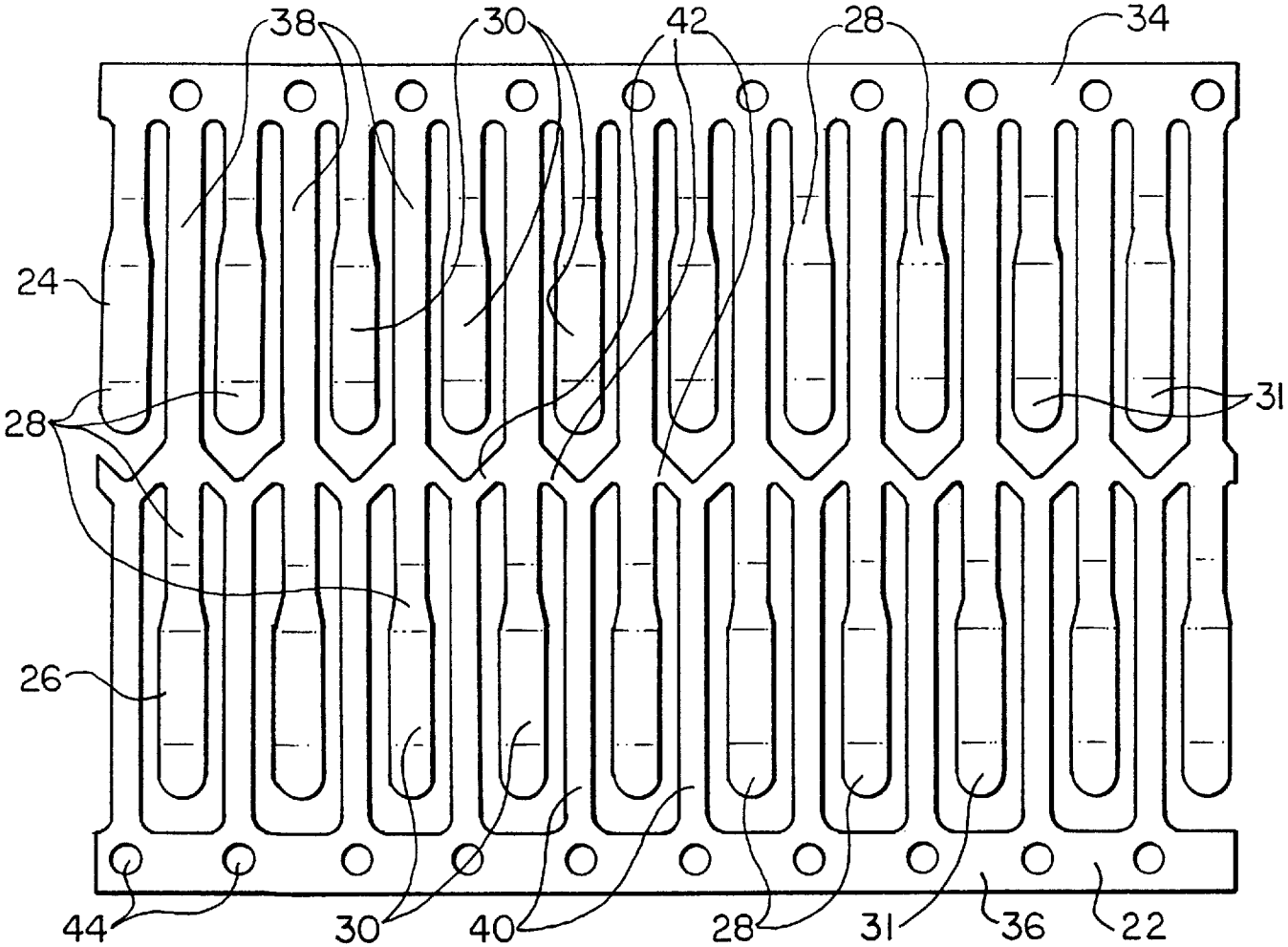
FIG. 6 is a plan view of the contact cage of FIG. 4 in an unrolled configuration.

Referring more particularly to FIGS. 6 and 7, the contact cage is formed in an unrolled configuration from any suitable electrically conductive metal. The cage has first and second longitudinal edge strips 34, 36. The edge strips are interconnected by two sets 38, 40 of transverse connecting members. Each set of transverse connecting members is offset from the other set and are joined by bridge members 42. The bridge members are preferably angled to have a zig-zag configuration. The zig-zag bridge configuration eases the process of rolling the cage into a generally cylindrical shape, discussed further below, and provides a compact design to reduce material consumption. The bridge members could, however, be linearly aligned to be parallel to the first and second edges if desired.

The first set 24 of flexible beams 28 extends from the first longitudinal edge strip 34. The second set 26 of flexible beams 28 extends from the first set 38 of transverse connecting members. As can be seen in FIG. 6, the first set 24 of beams is preferably offset from the second set 26 of beams. Each beam preferably is formed to include at least one protruding section 30 extending out of the plane when in the unrolled configuration for electrical contact with the pin or extending radially inwardly when the cage is rolled. The protruding sections 30 may be formed by bending the beams to bias the beams into contact with the pin. The tips 31 of the beams may be bent back down to electrically contact the housing. The protruding sections may be plated with a suitable electrically conductive plating material if desired. The beams may electrically contact the pin in any other suitable manner, as by welding a protrusion to the pin.

The cage 22 may be formed in any suitable manner, such as by stamping a sheet or strip of metal. Holes 44 in the first and second longitudinal edge strips may be provided to transport the sheet through the appropriate manufacturing equipment. A number of cages can be formed from a single sheet cut into segments of appropriate lengths. Any desired number of beams per cage and any desired length of cage may be provided, depending on the current carrying requirements of the component or components with which the cage is to be used. Generally, the current carrying capability increases with an increasing number of beams and a correspondingly increasing number of contact points. Similarly, more than one protrusion can be provided per beam or three or more sets of beams can be provided, if desired.

Figure 2:
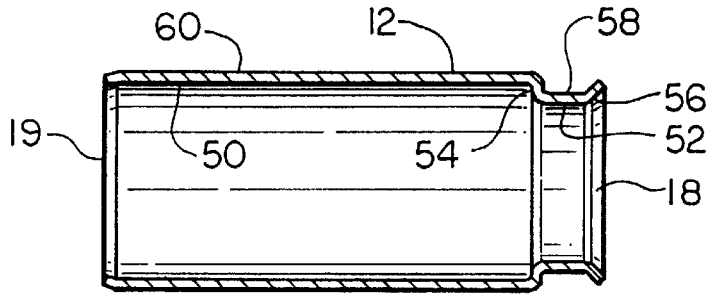
FIG. 2 is a cross-sectional side view of the housing of the connector assembly of FIG. 1.
Figure 3:
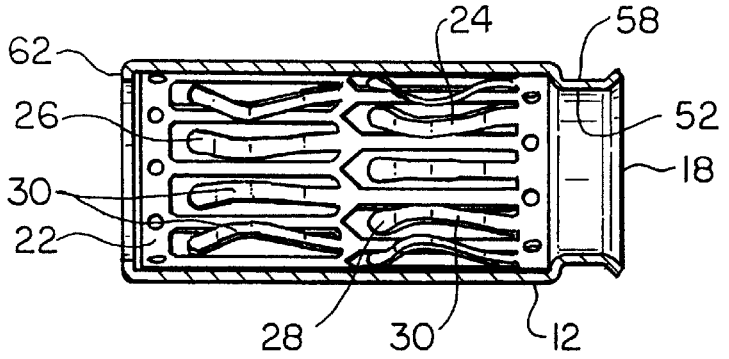
FIG. 3 is a cross-sectional side view of the housing and contact cage of the connector assembly of FIG. 1.
Figure 4:
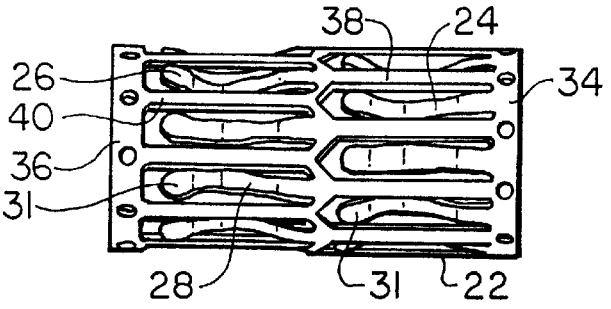
FIG. 4 is a side view of the contact cage of the connector assembly of FIG. 1.
Figure 5:
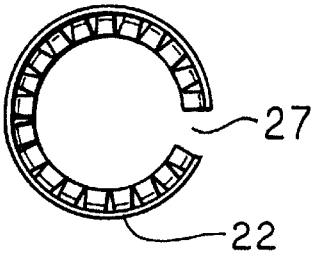
FIG. 5 is an end view of contact cage of FIG. 4.

Referring to FIGS. 2 and 3, the housing 12 is a cylindrical member formed from any suitable electrically conductive metal. The housing is preferably open at both ends 18, 19. Near one end 18, the inner wall 50 of the housing includes a section 52 having a reduced diameter. This section acts as an overstress protector for the contact cage 22 by minimizing movement of the pin 20 within the housing. This section also provides a positive stop 54 for the contact cage once it is assembled within the housing. The inner edge 56 near the reduced diameter section may be chamfered to ease insertion of the pin 20 into the housing. The housing may also include an annular recess 58 in the exterior wall 60 which serves as a keying feature for connection of the housing to another component, such as a bus bar 14 as shown in FIG. 1.

During assembly, the contact cage 22 is rolled into a generally cylindrical shape having a diameter slightly greater than the inner diameter of the housing and with the protrusions on the beams extending radially inwardly. The cage is compressed and inserted into the housing 12, preferably from the end 19 opposite the reduced diameter section 52 until it abuts the stop 54. Once in the housing, the cage is released to spring open against the inner wall of the housing. Electrical communication is made from the inserted pin through the beams to the body of the cage to the inner wall of the housing. Secondary communication can occur if the tips of the beams also directly contact the housing inner wall, should an application employ full deflection of the beam to make contact with the housing wall. Preferably, the length of the cage is selected so that the width of the split 27 is minimized when the cage springs open in the housing. The edge of the housing at the end 19 is then rolled or crimped over the cage to form an annular lip 62 to retain the cage between the stop 54 and the lip 62. Alternatively, the cage could be inserted through the end near the reduced diameter section if desired, although the cage would have to be rolled into a smaller diameter cylinder to clear the reduced diameter section if present. This manner of assembly may be used if the opposite end is closed.

The two sets 24, 26 of contact beams 28 in the cage 22 provide for a distribution of current throughout the housing 12. The two sets of beams also reduce the force required to insert the pin 20 into the housing 12. The force required initially to deflect the beams 28 is significantly greater than the force required to slide the pin over the already deflected beams. Thus, in determining the entire system insertion force, only the force required to deflect the second set of beams and the lesser sliding force of the pin over the first set of beams need to be taken into account.

The housing 12 may be attached to a component such as a bus bar 14 having two sets 66, 68 of a plurality of flexible fingers. The fingers provide an interface to the housing having multiple contact points with high forces which are normal to the housing. The end of each finger is preferably formed into a V or U shape to provide two points of contact 70 with the housing per finger, one at each edge of the finger, thereby increasing the current carrying capability and/or reducing the operating temperature of the connector. At least one set of fingers may be retained within the annular recess 58 in the housing. This annular recess may be conveniently formed adjacent the reduced diameter section of the housing. Another annular recess may be provided to receive the other set of fingers if desired, although this is not generally necessary.

Figure 9:
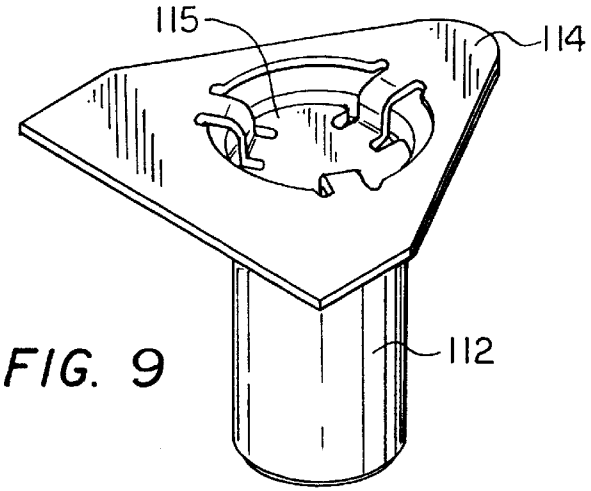
FIG. 9 is an isometric view of the component feed of the connector assembly of FIG. 8.
Figure 10:
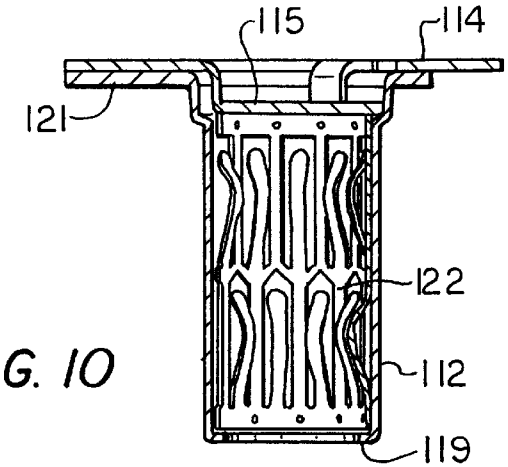
FIG. 10 is a side cross-sectional view of the housing and contact cage of the connector assembly of FIG. 8.
Figure 8:
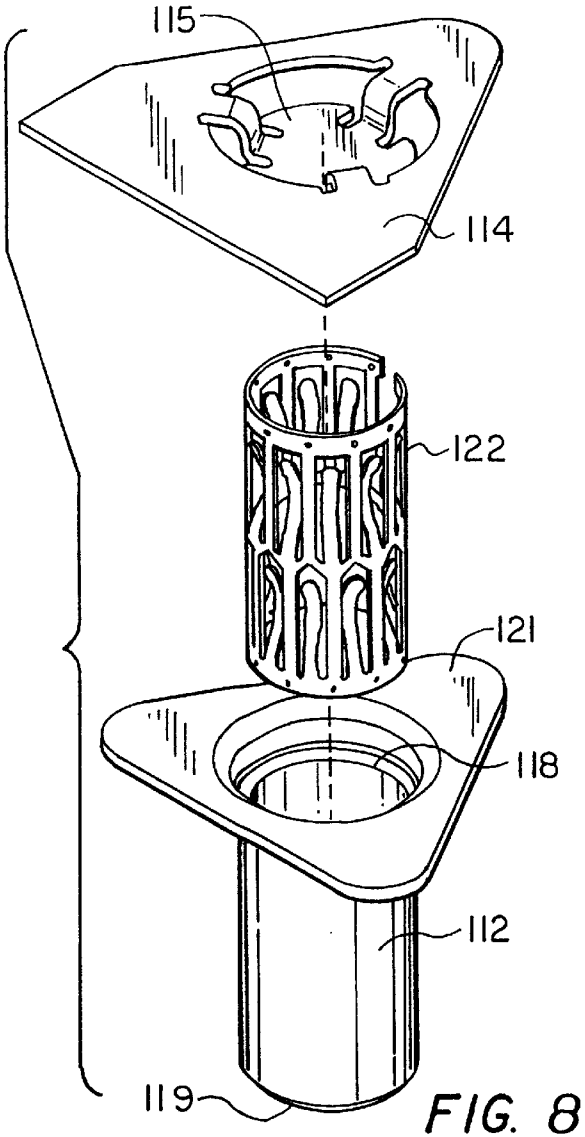
FIG. 8 is an isometric exploded view of a further embodiment of an electrical connector assembly according to the present invention.

Another embodiment of an electrical connector assembly of the present invention is illustrated in FIGS. 8 through 10. A cage 122, which may be as described above, is inserted into a cylindrical housing 112 through either end 118 or 119. The end 119 of the housing may include a lip, for example, formed by crimping, to hold the cage in the housing. Alternatively, the opposite end of the housing may be closed. The housing also includes a collar 121 around the open end 118. A component feed 114 is fixed in electrical contact to the collar 121 of the housing 112. The component feed includes a plate 115 for retaining the cage 122 in the housing.

As will be appreciated by those in the art, the contact cage of the present invention may be used with other forms of cylindrical housings. Similarly, other pins, such as solid pins, may be inserted within the cage in the housing. Additionally, the housing may be attached to components via other bus bar or component feed configurations besides those such as specifically depicted herein.

The invention is not to be limited by what has been particularly shown and described, except as indicated by the appended claims.

I claim:

1. An electrical connector assembly comprising:

a cylindrical housing formed of an electrically conductive material, the housing having at least one open end and including an interior wall defining a socket for receiving an electrically conductive pin; and a contact cage formed of an electrically conductive material and concentrically disposed within the socket in electrical communication with the interior wall of the housing, the contact cage having a cylindrically rolled configuration and comprising two sets of resilient beams supported by longitudinal strips, a first set of the two sets offset from a second set of the two sets, the second set of the two sets displaced relative to the first set transversely along a distance between the longitudinal strips, each of the resilient beams including a protruding section extending radially inwardly for electrical communication to the electrically conductive pin receivable in the socket.

2. The electrical connector assembly of claim 1, wherein the contact cage further includes two sets of transverse members extending from the longitudinal strips, the two sets of transverse members offset from each other and joined by bridge members.

3. The electrical connector assembly of claim 1, wherein the bridge members have a zig-zag configuration.

4. The electrical connector assembly of claim 1, wherein the second set of beams extends integrally from the first set of transverse members.

5. The electrical connector assembly of claim 1, wherein the protruding sections of the beams comprise bent portions of the beams.

6. The electrical connector assembly of claim 1, wherein the housing includes a stop member interiorly formed therein at one end to abut against the cage.

7. The electrical connector assembly of claim 1, wherein the housing includes a reduced diameter section sized to retain the electrically conductive pin therein to reduce stress on the contact cage.

8. The electrical connector assembly of claim 1, wherein the housing includes an annular inwardly directed lip at an end opposite the open end to retain the cage within the housing.

9. The electrical connector assembly of claim 1, further comprising a bus bar electrically connected to the housing.

10. The electrical connector assembly of claim 1, wherein the housing includes an annular recess exteriorly formed therein to provide a keying feature for connection to a component.

11. The electrical connector assembly of claim 10, further comprising a bus bar electrically connected to the housing, the bus bar including a set of radially inwardly extending fingers.

12. The electrical connector assembly of claim 11, wherein each of the fingers includes an end shaped to provide one or two points of contact with the annular recess of the housing.

13. The electrical connector assembly of claim 1, wherein the housing includes a collar and further comprising a component feed having a portion in electrical contact with the housing.

14. The electrical connector of claim 13, wherein the component feed includes a cage retaining plate disposed to fit within the socket of the housing in contact with the cage.

15. An electrical connector assembly comprising:

a cylindrical housing formed of an electrically conductive material, the housing having at least one open end and including an interior wall defining a socket for receiving an electrically conductive pin, the housing further including an annular recess exteriorly formed therein to provide a keying feature for connection to a component; and a contact cage formed of an electrically conductive material and concentrically disposed within the socket in electrical communication with the interior wall of the housing, the contact cage having a cylindrically rolled configuration and comprising two sets of resilient beams supported by longitudinal strips, a first set of the two sets offset from a second set of the two sets, each of the resilient beams including a protruding section extending radially inwardly for electrical communication to the electrically conductive pin receivable in the socket.

16. An electrical connector assembly comprising:

a cylindrical housing formed of an electrically conductive material, the housing having at least one open end and including an interior wall defining a socket for receiving an electrically conductive pin, the housing further including a collar;

a contact cage formed of an electrically conductive material and concentrically disposed within the socket in electrical communication with the interior wall of the housing, the contact cage having a cylindrically rolled configuration and comprising two sets of resilient beams supported by longitudinal strips, a first set of the two sets offset from a second set of the two sets, each of the resilient beams including a protruding section extending radially inwardly for electrical communication to the electrically conductive pin receivable in the socket; and a component feed having a portion in electrical contact with the housing and including a cage retaining plate disposed to fit within the socket of the housing in contact with the cage.

* * * * *